US008234898B1

(12) United States Patent
Wilson

(10) Patent No.: US 8,234,898 B1
(45) Date of Patent: Aug. 7, 2012

(54) BENDING ASSEMBLY FOR EXTRUDED STOCK MATERIAL

(76) Inventor: Brian S. Wilson, Boca Raton, FL (US)

( * ) Notice: Subject to any disclaimer, the term of this patent is extended or adjusted under 35 U.S.C. 154(b) by 701 days.

(21) Appl. No.: 12/316,523

(22) Filed: Dec. 12, 2008

(51) Int. Cl.
*B21D 9/05* (2006.01)
*B21D 7/04* (2006.01)

(52) U.S. Cl. ..... 72/150; 72/154; 72/155; 72/217; 72/370.01

(58) Field of Classification Search ..... 72/149, 72/150, 152, 154, 155, 217, 342.94, 369, 72/370.01, 370.08, 387, 388
See application file for complete search history.

(56) References Cited

U.S. PATENT DOCUMENTS

| | | | | | |
|---|---|---|---|---|---|
| 2,143,442 | A | * | 1/1939 | Kellogg | 72/166 |
| 2,153,935 | A | | 4/1939 | Neukirch | |
| 2,414,926 | A | | 1/1947 | Burke | |
| 3,763,685 | A | | 10/1973 | Fjellstrom | |
| 4,012,933 | A | | 3/1977 | Porter | |
| 4,055,065 | A | | 10/1977 | Whetstone, Jr. et al. | |
| 4,137,743 | A | * | 2/1979 | Schwarze | 72/150 |
| 4,198,840 | A | | 4/1980 | Nielsen et al. | |
| 4,604,885 | A | | 8/1986 | Lang | |
| 4,608,849 | A | * | 9/1986 | Brugman | 72/217 |
| 4,798,073 | A | | 1/1989 | Dischler | |
| 4,848,120 | A | * | 7/1989 | Schwarze | 72/31.04 |
| 4,890,469 | A | | 1/1990 | Dischler | |
| 4,909,059 | A | | 3/1990 | King | |
| 5,104,026 | A | * | 4/1992 | Sturrus et al. | 72/369 |
| 5,231,907 | A | | 8/1993 | Matsuoka | |
| 5,390,522 | A | | 2/1995 | Dircks | |
| 6,009,737 | A | * | 1/2000 | Bandy | 72/150 |
| 6,769,282 | B2 | | 8/2004 | Henden | |
| 7,032,422 | B2 | * | 4/2006 | Hatano | 72/150 |
| 7,140,224 | B2 | * | 11/2006 | Luo et al. | 72/369 |

* cited by examiner

*Primary Examiner* — David Jones
(74) *Attorney, Agent, or Firm* — Clifford Kraft

(57) ABSTRACT

A bending assembly for extruded, stock material specifically including elongated channel stock initially supported on a mandrel in an operative position relative to a forming assembly which includes a movable section and a fixed section. The movable section includes a forming channel disposed about a periphery thereof and having a predetermined curved configuration corresponding to the intended curve of the stock material to be bent. Cooperative placement and structuring of the movable and fixed sections continuously force the stock material into the forming channel and along the length thereof upon travel of the movable section through a forming cycle. A locking assembly is structured to secure the stock material to the movable section, such that the stock material moves relative to the both the movable and fixed sections and with the movable section during the forming cycle. A brace assembly is mounted interiorly of the stock material in order to prevent unwanted deformation thereof.

4 Claims, 8 Drawing Sheets

BENDING ASSEMBLY FOR EXTRUDED STOCK MATERIAL

BACKGROUND OF THE INVENTION

1. Field of the Invention

The present invention is directed to a bending assembly structured to form extruded stock material, specifically including channel stock, into a predetermined curved configuration. A forming assembly includes cooperatively disposed and structured movable and fixed sections which bend the stock material into the predetermined configuration while eliminating the possibility of unwanted deformation or disfiguring of the stock material during the forming cycle.

2. Description of the Related Art

The need for bending various stock material pieces specifically, but not exclusively, extruded metal stock pieces is well known. As such, conventional equipment associated with this type of forming includes a variety of different structures and operational capabilities. The large number of different bending machines or like forming assemblies is due, at least in part, to the various types of metal or other material stock which requires either a substantially standard or customized bending for installation and use in specific applications.

In typical form, known bending machines may include one or more rollers or like forming members are disposed in cooperative relation to one another. Moreover, at least some of the cooperatively disposed and structured forming members move relative to one another while concurrently engaging and forcing a length of the stock material into a desired configuration. However, certain shapes of standard stock materials being formed present difficult and problems which may be somewhat unique to stock pieces of that particular structure. Such problems especially relate to the efficient bending or forming of such common stock pieces while eliminating unwanted and/or disfiguring deformation thereof. By way of example, it is particularly problematic to accurately bend or form tubular pieces specifically including channel stock pieces. Channel stock pieces are commonly characterized by a hollow interior and an at least partially surrounding exterior base and are typically extruded.

Accordingly, it would be highly desirable to accomplish the bending or forming of various channel stock and other stock pieces in a manner which maintains a uniform cross section of the piece including a consistent interior transverse or sectional dimension extending along the length thereof. Moreover, problems associated with conventional or known bending machines and or procedures include the tendency of hollow interior metal stock pieces, specifically including channel stock, to twist or otherwise be distorted. Channel stock is of particular note since it generally includes a web or base having two outwardly extending flanges disposed on opposite sides of an elongated opening channel which leads to a larger, hollow interior channel.

Attempts to overcome problems and disadvantages of the type set forth above have been unsuccessful even when such attempts have resulted in the use or design of expensive, overly complicated forming dies and/or other structural components which may have been used in combination with such forming dies. Accordingly, there is a long standing need in the bending or forming industry for an improved bending assembly which is capable of bending or forming extruded stock material specifically including extruded, metallic material, channel stock in a manner which has previously not been possible. Such an improved and proposed bending assembly should be capable of forming the stock material into a predetermined standard or customized curved configuration without causing disfiguring or unwanted deformation of the stock material. Concurrently, the intended bending or forming should be accomplished in a manner which maintains a consistent cross sectional dimension and configuration of the channel stock material, as it is processed through the one or more forming cycles of the proposed bending assembly. Further, the simplicity of design and versatility of operation also allows efficient utilization of such a preferred and proposed bending assembly by individuals without a significant degree of training or experience in the bending or forming art. Finally, the construction of such a preferred bending assembly is such that it is sufficiently durable to have long operable life even when used in a relatively harsh production environment.

SUMMARY OF THE INVENTION

This invention is directed to a bending assembly which is specifically, but not exclusively, intended for the forming of extruded metal stock, such as channel stock. Moreover, the bending assembly of the present invention includes an elongated mandrel disposed in a fixed position operatively adjacent to a forming assembly. The mandrel is dimensioned and configured for disposition within the interior of the extruded stock material being formed so as to support the stock material in an appropriate and/or operative position prior to, during and after a forming cycle and cooperative relation to the forming assembly.

The forming assembly includes a movable section and a fixed section disposed on opposite sides of the mandrel and the stock material supported thereon. The fixed section is disposed in a predetermined, fixed location such that the stock material is disposed in movable, sliding engagement therewith as the stock material passes through a forming cycle. Cooperatively, the movable section is movable or more specifically rotatable as it travels through the forming cycle. Accordingly, the placement of the mandrel in supporting relation to the stock material serves to movably "sandwich" the stock material between the fixed section and the movable section.

Additional structural features of the movable section include a forming channel structured and disposed along at least a portion of the periphery of the movable section. The forming channel is disposed and structured to continuously and forcibly receive the stock material upon rotational travel of the movable section through the forming cycle. Further, the interaction and sliding engagement of the stock material with the fixed section, as well as the cooperative disposition of the fixed section relative to the movable section serves to force the stock material, continuously along its length, into the peripheral forming channel. As such forced positioning of the stock material occurs it will be bent into a curved configuration defined by and corresponding to the predetermined, curved configuration of the peripheral channel of the movable section.

In order to maintain a proper orientation and position of the stock material relative to the peripheral forming channel during the forming cycle, the bending assembly of the present invention includes a locking assembly. The locking assembly is disposed and structured to removably but securely mount the stock material on the movable section. As such that the stock material moves with and relative to the movable section as the movable section travels through the aforementioned forming cycle. Therefore, the structural and operative features of the locking assembly include a locking clamp which is connected to the movable section and movable therewith during the rotational travel of the movable section through the forming cycle. Further, the locking clamp initially engages and removably but securely locks or clamps one end portion of the stock material to the movable section and more specifically into a correspondingly disposed part of the peripheral forming channel.

In addition, the locking assembly may also include a closure member which is preferably in the form of a reciprocally mounted plate which is disposed to at least partially define a portion or boundary of the forming channel. Therefore, when the locking assembly is activated, the locking clamp engages the one end portion, as set forth above, substantially concurrently to the closure plate or member being disposed in overlying, at least partially "closing" relation to the upper or corresponding part of the forming channel. Disposition of the locking member or plate in the aforementioned closed position will at least partially restrict movement the clamped end portion of the stock material, also being held in place by the locking clamp. However, the positioning of the closure member or closure plate associated with the movable section is such as to still facilitate forced and continuous disposition of the stock material into the forming channel upon the rotational travel of the movable section and the cooperative forced engagement of the fixed section. Therefore, the stock material will be bent into the predetermined curved configuration associated with or corresponding to the configuration of the peripheral channel.

Additional structural and operative feature of the bending assembly of the present invention is the inclusion of a brace assembly. The brace assembly comprises at least one but preferably a plurality of two brace members, each of which are dimensioned and configured to fit on the interior of different parts of the stock material being bent. Further, the disposition and structure of each of the preferably two brace members is such as to prevent or significantly reduce the possibility of damage or deformation of the stock material as it is being secured to the movable section of the forming assembly as well as during its bending, while the movable section travels through the forming cycle.

In more specific terms, at least one of the brace members includes an elongated configuration formed of a plastic or other appropriate material and disposed between the open channels of the extruded stock material being bent. Placement of the elongated brace member in this location of course assumes that the stock material being bent or formed into a curved configuration is an extruded channel stock piece. The other of the preferably two brace members includes a block or similar structure which is dimensioned and configured to fit within the interior of one end portion of the stock material being formed. As such, the block-type brace member is disposed within the interior of the one end portion which is initially locked into the forming channel immediately prior to the movable section traveling through the forming cycle. As set forth above, the locking assembly includes the locking clamp which, when activated, serves to removably but securely clamp the aforementioned one end portion, with the block brace member on the interior thereof, into locking engagement on the interior of the forming channel of the movable section. Placement of the brace members in the manner set forth above will eliminate or significantly reduce the possibility of unwanted deformation or disfiguring of the stock material piece while it is being bent. However, the disposition of the brace members in the manner described will not interfere with the stock material being properly bent or formed into the predetermined configuration at least partially defined by the curved configuration of the forming channel.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
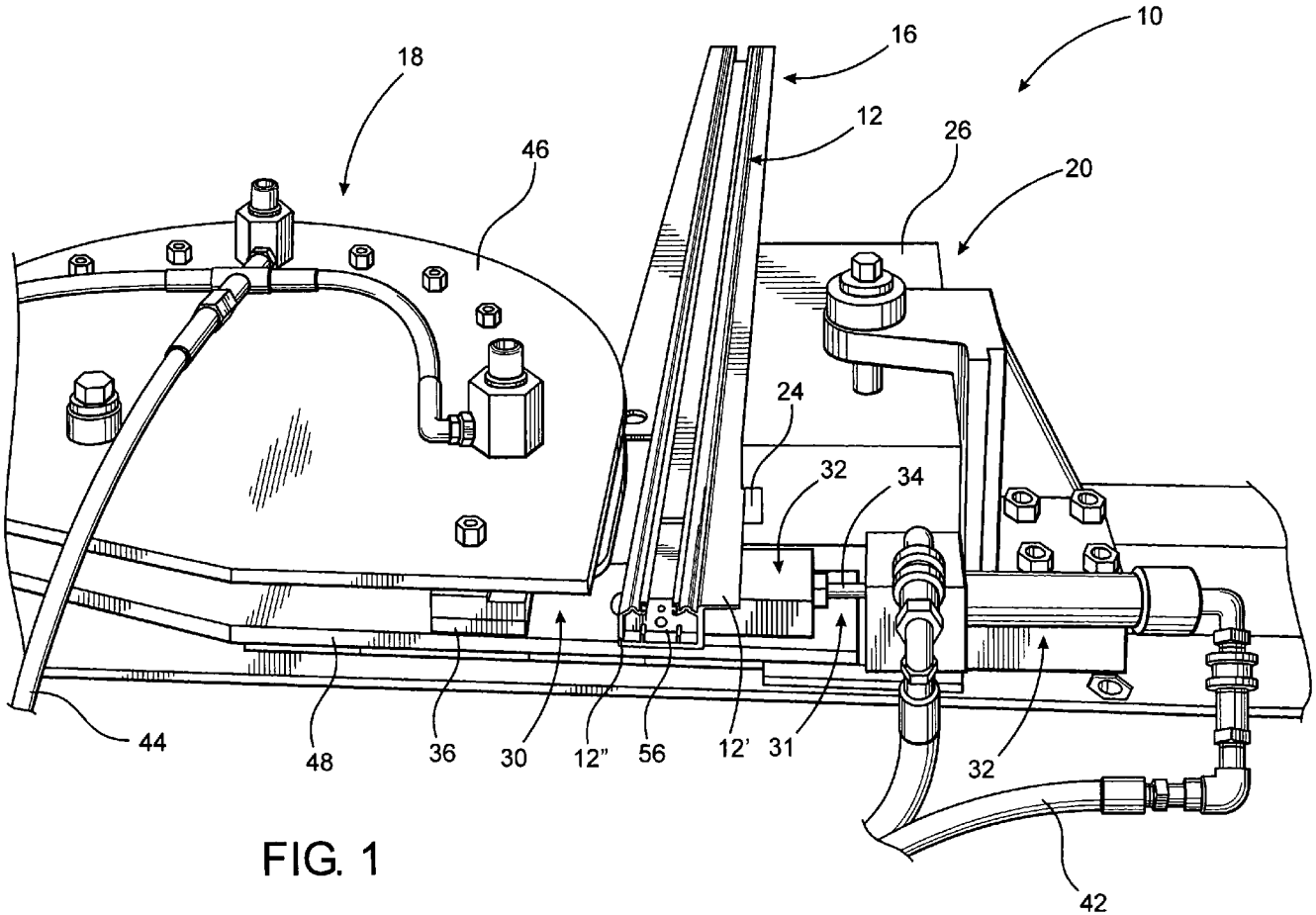
FIG. 1 is a perspective view in partial cutaway of a bending assembly of the present invention.
Figure 2:
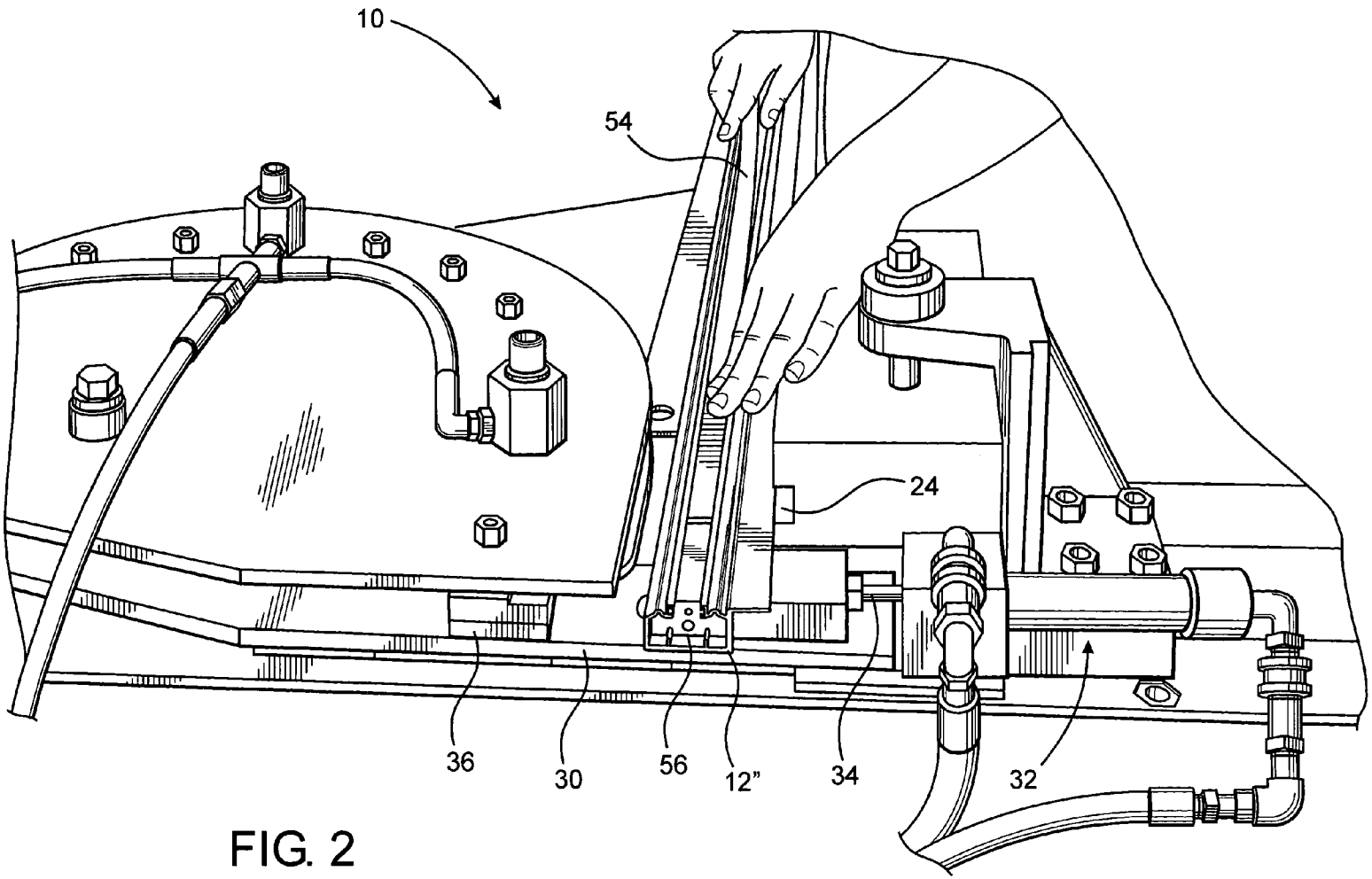
FIG. 2 is a perspective view in the embodiment of FIG. 1 during a different, successive portion of the forming cycle.
Figure 3:
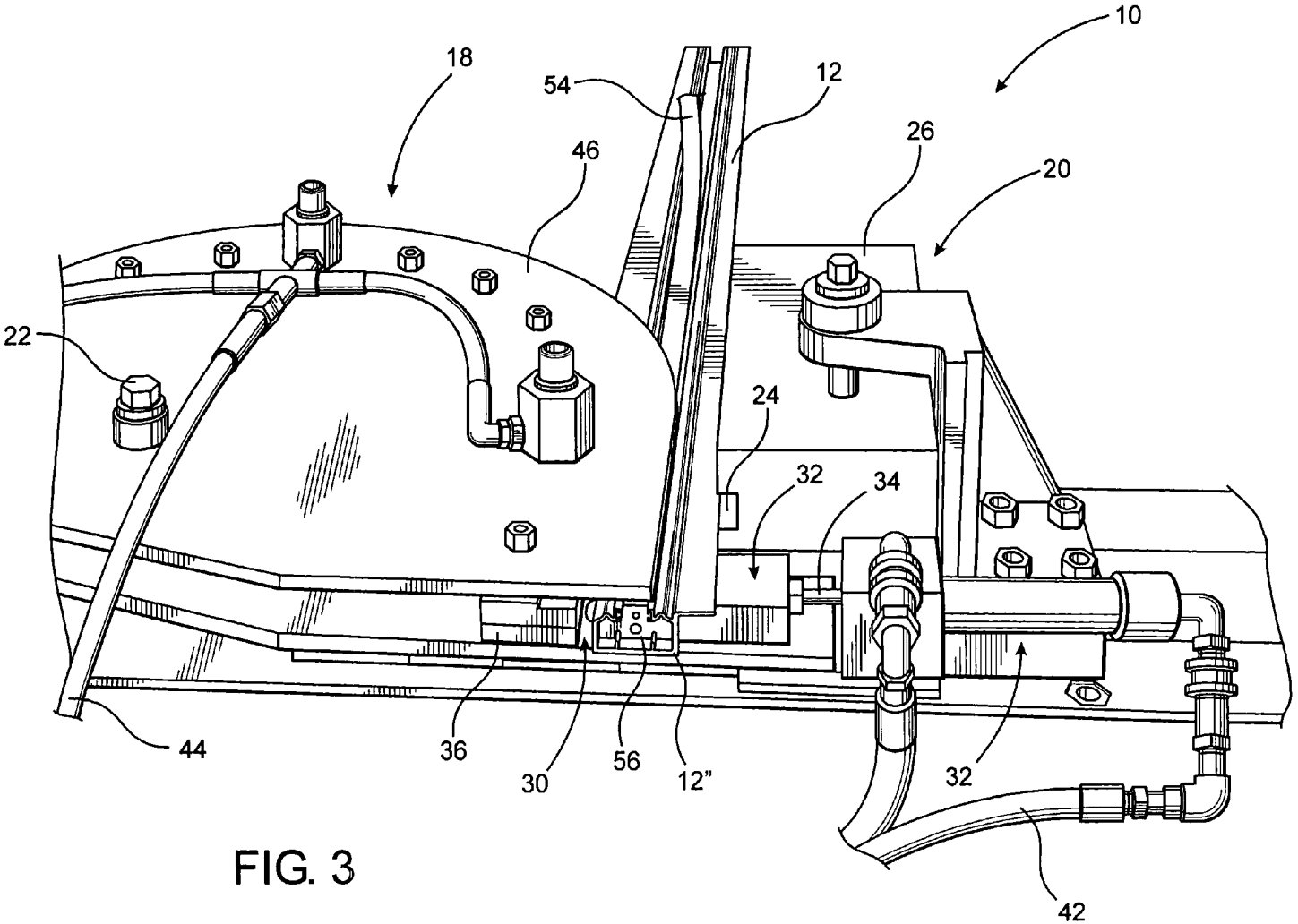
FIG. 3 is a perspective view of the embodiment of FIGS. 1 and 2 in yet a different successive portion of the forming cycle.
Figure 4:
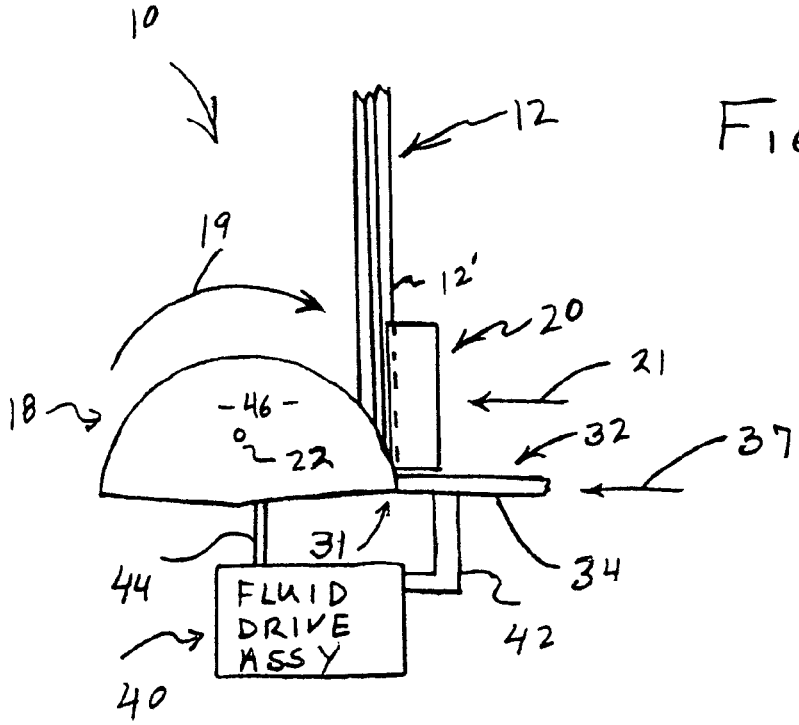
FIG. 4 is a schematic representation of the bending assembly of the present invention wherein the various components thereof are disposed at the beginning of a forming cycle similar to the embodiment of FIG. 3.
Figure 5:
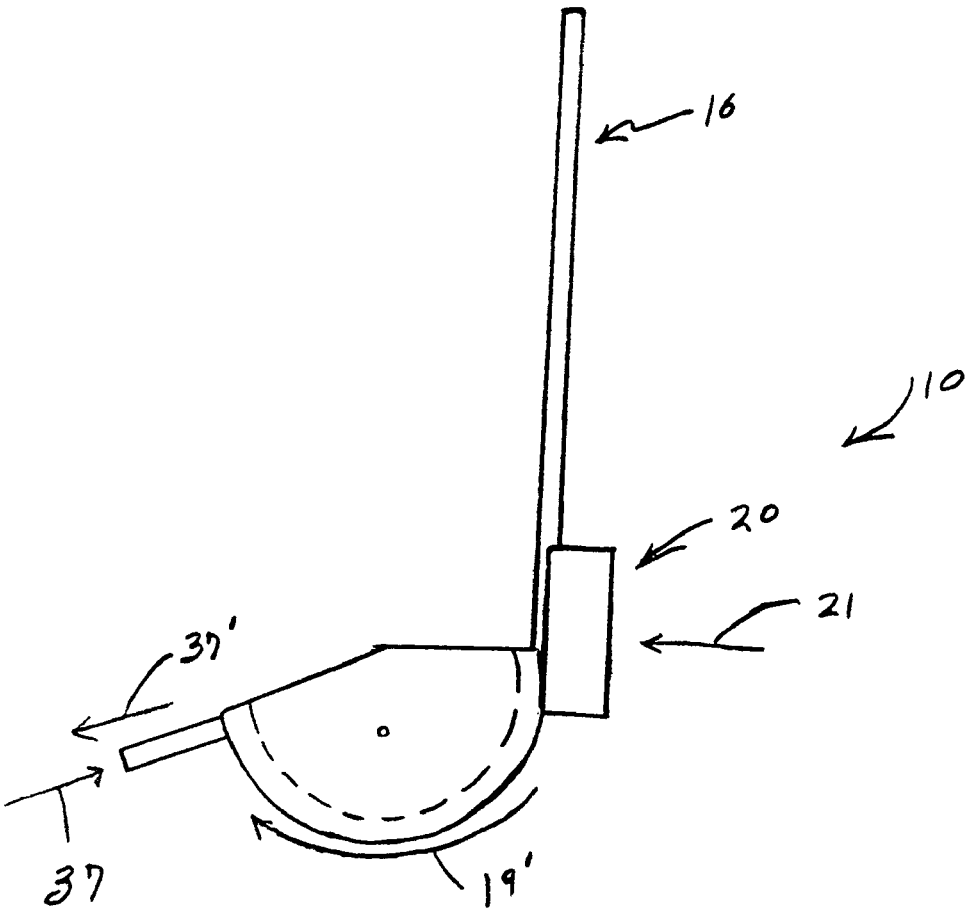
FIG. 5 is a schematic representation of the embodiments of FIGS. 1 through 4 wherein the forming assembly is at the end of a forming cycle.
Figure 7A:
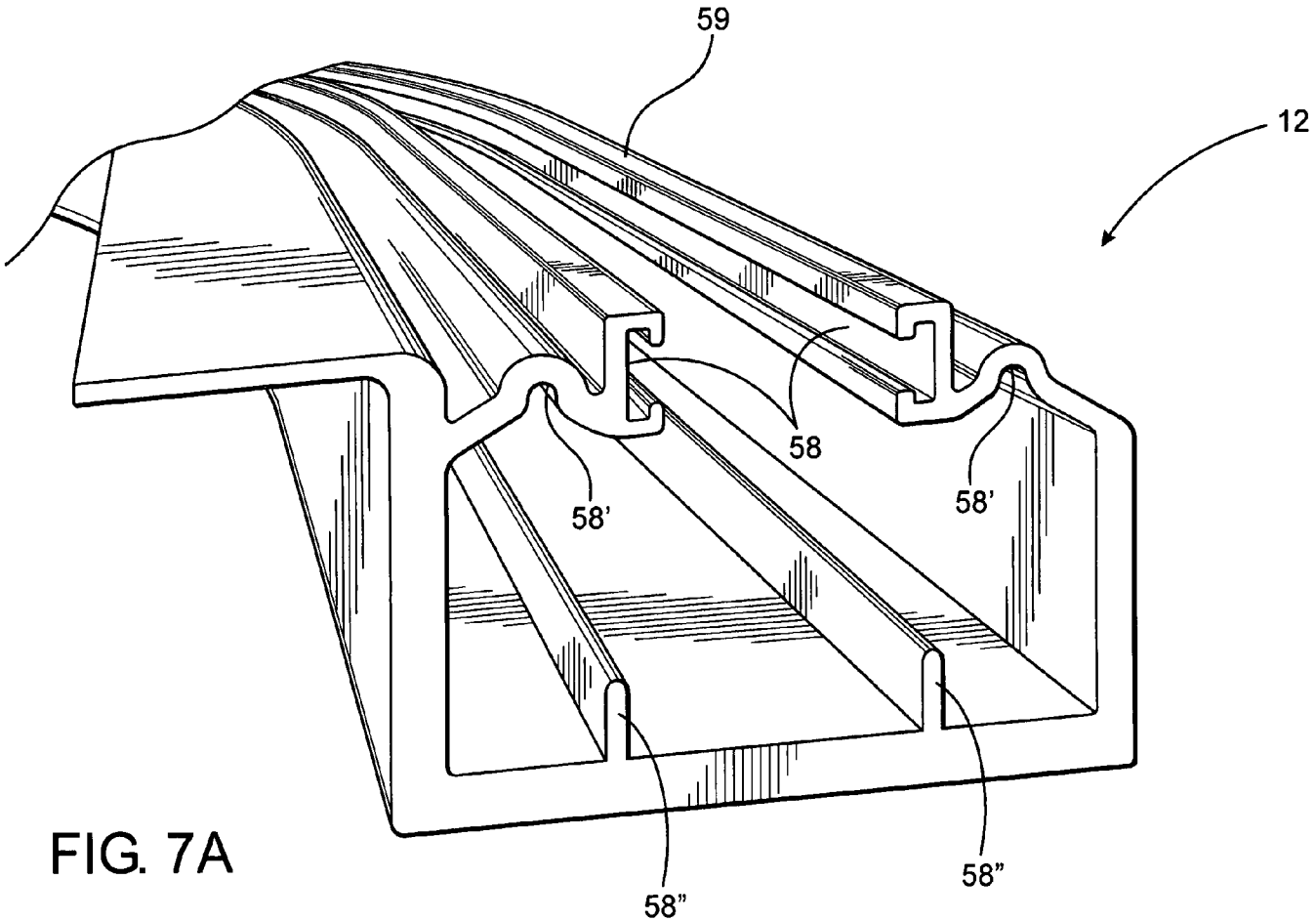
FIG. 7A is an end view in partial cutaway showing interior portions of the extruded stock material of the type to be formed utilizing the bending assembly of the present invention.
Figure 8:
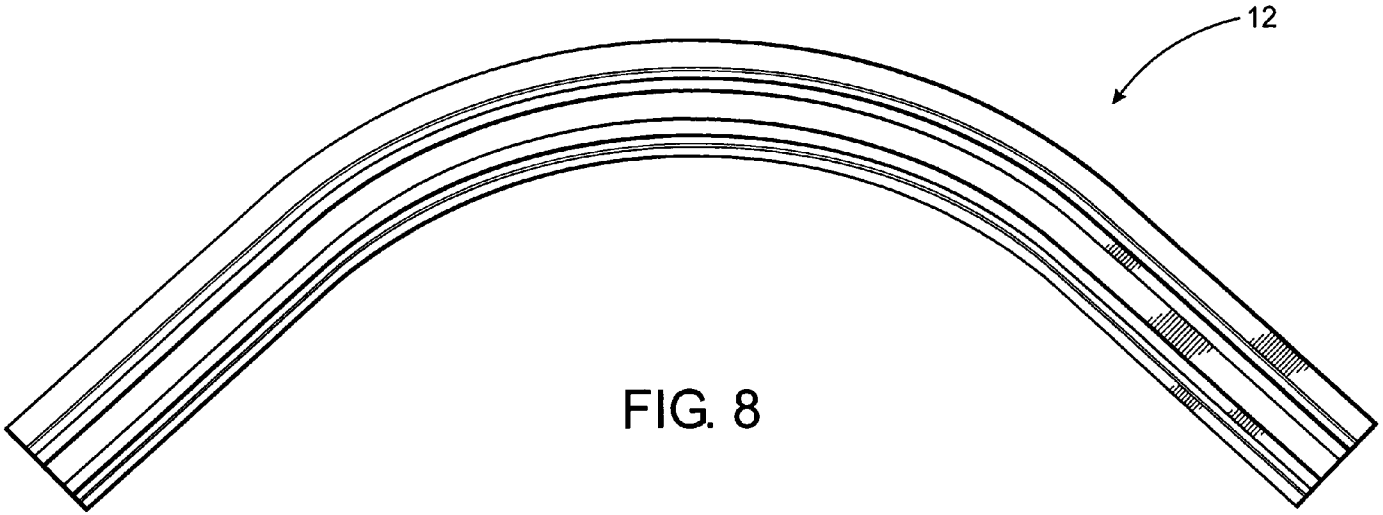
FIG. 8 is a completely formed extruded stock material piece bent into a curved configuration utilizing the bending assembly of the present invention.
Figure 9:
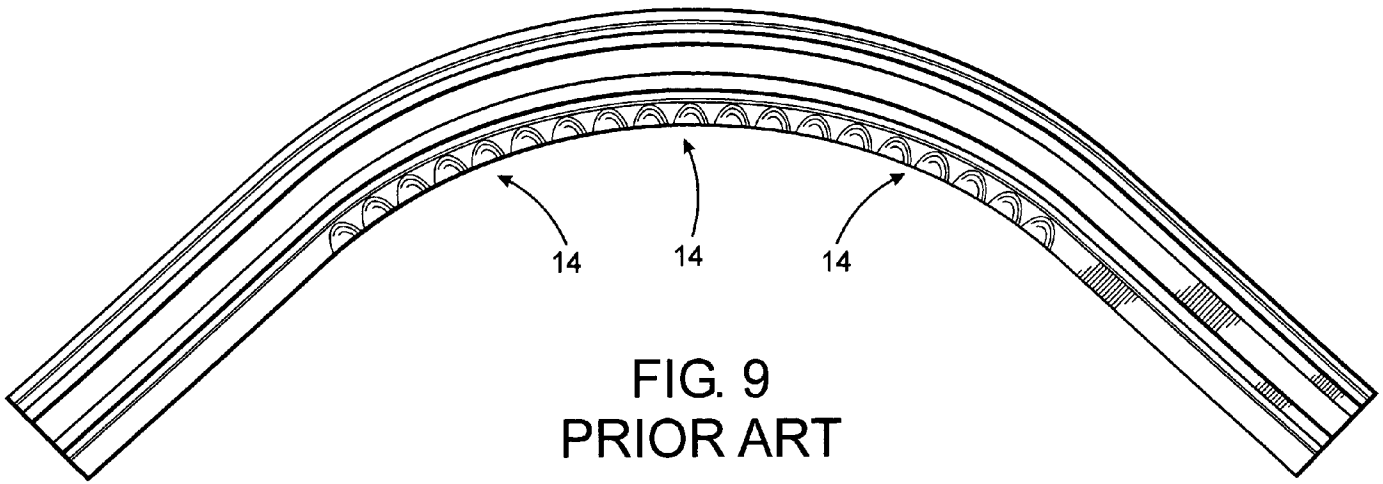
FIG. 9 PRIOR ART
FIG. 9 is an extruded channel stock material piece including a typical undesirable deformation of the type resulting from the use of prior art bending assemblies and/or techniques.

The present invention is directed to a bending assembly generally indicated as 10 in FIGS. 1 through 5, wherein FIGS. 4 and 5 are schematic representations. More specifically, the embodiments represented in FIGS. 1 through 3 show the preparatory steps of "loading" a material piece specifically of the type more commonly known in the industry as "channel stock" 12 as represented in FIGS. 7A and 8. With reference to FIG. 9, channel stock is also represented therein as "prior art" which is formed utilizing known or conventional bending devices. As such, the prior art channel stock piece of FIG. 9 demonstrates certain unwanted and inadvertent deformations formed along the inner peripheral flange, generally indicated as 14. It is emphasized that other metallic extruded stock material pieces may be formed or bent utilizing the bending assembly 10 of the present invention. However, the structural and operative features, to be described in greater detail hereinafter, specifically facilitate the curved, bending or forming of the channel stock 12, without the unwanted deformation 14 of FIG. 9.

Accordingly, with primary reference to FIGS. 1 through 5, the bending assembly 10 of the present invention includes an elongated supporting frame or mandrel 16 having a linear configuration which is disposed in supporting relation to the channel stock 12 during the forming or bending procedure. The mandrel 16 supports.

Further, the bending assembly 10 includes a forming assembly comprising a movable section or forming die generally indicated as 18 and a fixed section generally indicated as 20. As such, the fixed section 20, while being selectively movable into operative position, as schematically represented by directional arrow 21 in FIG. 4, forcibly engages the stock material 12 supported on the elongated frame portion 16, as represented in FIGS. 1 through 3. However, during the forming cycle, the fixed section 20 is maintained in a fixed location relative to the frame portion 16 and in sliding engagement with the corresponding peripheral or longitudinal side 12' of the stock material 12 as well as a flange portion 12" thereof. In addition, the forming die or movable section 18, when activated, is rotational about an axis of rotation 22 as it travels through the forming cycle.

More specifically, and with primary reference to FIGS. 4 and 5, the movable section 18 is represented in FIG. 4 at the beginning of the forming cycle. Similarly the fixed section 20 is also operatively disposed in engaging relation to a corresponding peripheral side and/or flange 12" of the channel stock or other stock material 12, after having been moved from its non-engaging position, again as schematically represented by the directional arrow 21. As will be apparent hereinafter, the stock material 12 is drawn or forced to travel in sliding engagement with the corresponding longitudinal side of the fixed section 20. Moreover, the fixed section 20 is structured to facilitate the sliding engagement of the stock piece 12 therewith by the inclusion of an appropriately dimensioned and configured channel or recessed portion 24.

With primary reference to FIGS. 1 through 3, the open sided receiving channel 24 extends along the length of the fixed section base 26. The dimension, disposition and configuration of the receiving channel 24 is such as to allow sliding passage of the corresponding peripheral side or edge of the stock piece 12, including the flange 12" through the receiving channel 24, once the fixed section 20 and the movable section 18 are brought into a cooperative operative position relative to one another as schematically represented in FIG. 4. FIG. 4 also schematically represents the positioning of the fixed section 20 being sufficiently close to the movable section 18 so as to force the stock material 12 continuously into the forming channel 30 upon rotational travel of the movable section 18 through the forming cycle 19, 19'.

Again it is emphasized that FIG. 4 is a schematic representation of the bending assembly 16 at the beginning of the forming cycle prior to the bending or forming of the stock material 12. However, the fixed section 20 remains in sufficiently close proximity to the movable section 18 during the entire rotational travel of the movable section 18 to assure that the stock material 12 is continuously forced into the forming channel 30 along its length until the movable section 18 reaches the end of the forming cycle, as at 19' in FIG. 5. More specifically and for purposes of clarity, the rotational movement of the movable section 18 is schematically represented by directional arrow 19 in FIG. 4 and by directional arrow 19' in FIG. 5. As such FIGS. 4 and 5 respectively represent the beginning and end of the forming cycle, wherein the movable section 18 rotates, as it travels through the forming cycle relative to the mandrel 16 and the fixed section 20. As set forth above, the movable section 18 includes the forming channel generally indicated as 30, which is dimensioned and configured to receive the channel stock or stock material 12 therein. Further, the stock material 12 is maintained in the forming channel due to the forced engagement of the stock material 12 by the fixed section 20, as schematically represented by directional arrow 21. This forced positioning or engagement of the fixed section 20 with the stock material 12 will be maintained throughout the entire forming cycle and continuously during the rotational travel 19 and 19' of the movable section 18.

Additional features of the bending assembly 10 include the provision of a locking assembly 31 which serves to removably but securely position the stock material 12 within the channel 30. More specifically, the locking assembly 31 includes a locking clamp generally indicated as 32. The locking clamp 32 comprises an elongated clamp arm 34 which, when activated, will force the clamp 32 into engaging and clamping relation with the end portion 12" of the stock material 12. This in turn will force and maintain the stock material 12 into the forming channel 30 and against the channel base 36. Therefore, the activation, positioning and clamping force of the locking clamp 32 are schematically represented in FIGS. 4 and 5 as 37 and 37'. Such clamping force and positioning 37 is maintained on the one end portion 12" of the stock material 12 as long as the locking clamp 32 is activated, such as by a hydraulic or other fluid drive source or assembly generally indicated as 40. Interconnection of the fluid drive assembly 40 to the locking clamp 32 is accomplished by appropriate hoses or conduits as at 42. Similarly, the rotation of the mobile section 18 is also accomplished by the fluid drive assembly 40 due to a fluid interconnection in the form of a conduit or hose as at 44.

Accordingly, the aforementioned locking assembly 31 comprises the locking clamp 32 as well as a closure plate or closure member 46 which may be considered a part of a forming die of the movable section 18. More specifically, the locking assembly 31 also includes a lower plate 48 of the forming die or movable section 18, which is substantially fixed, as well as the upper closure plate or closure element 46 which is reciprocally movable relative to the base 36 of the forming channel 30 and the lower plate 48 of the movable section 18. Such reciprocal movement is schematically represented by arrows 49 and 49' respectively serves to close and open the forming channel 30. Such reciprocal movement is also accomplished by interconnection of the closure plate 46 to the fluid drive assembly 40 in any appropriate, operable manner.

Figure 6A:
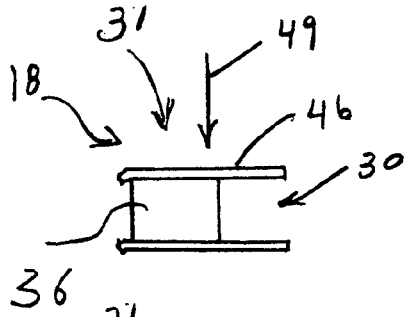
FIG. 6A is an end view in partial section and cutaway of a portion of the forming assembly and at least one closure component associated therewith in a closed position.

Therefore, activation of the locking assembly 31 will cause a substantially or at least partially concurrent movement of the locking clamp 32, including clamp arm 34, into fixed, clamping engagement with the one end portion 12" of the stock material 12, as well as the reciprocal movement of the closure plate 46 of the forming die or movable section 18. The locking clamp 32 thereby serves to maintain the one end 12" in a removable but securely locked position on the interior of the forming channel 30 and against the channel base 36 once the closure plate 46 is brought to the closed position as represented in FIG. 6A. When the locking assembly is activated, the closure plate or element 46 will pass downwardly into a "closing" relation to the forming channel 30 and against the channel base 36, substantially concurrently to the locking clamp 32 or clamp arm 34 securing the one end 12' into the channel 30. As such, the closure plate or element 46 substantially defines at least a portion of the boundary of the forming channel 30 when in a "closed" position or orientation.

Figure 6B:
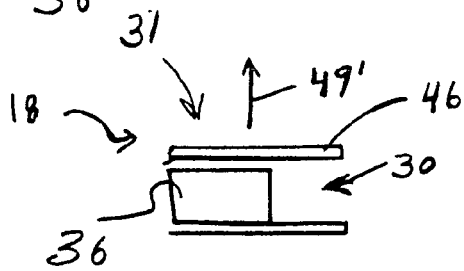
FIG. 6B is a sectional view in partial cutaway of the embodiment of 6A with the closure element in an open position.

It is of course noted that the outer peripheral side of the forming channel 30 is open so as to continuously and forcibly receive the stock material 12 therein during the rotational travel 19 and 19' of the forming die or movable section 18. Once the forming cycle has been completed, as schematically represented in FIG. 5, the locking assembly is released or deactivated such that the clamping force 37 normally exerted on the one end 12' by the locking clamp 32 is released as schematically indicated by directional arrow 37'. The release of the clamping force or position of the locking clamp 32 occurs substantially concurrently to the closure plate 46 moving to the "open" position as represented in FIG. 6B. Therefore, it should be apparent that the closure plate 46 is reciprocally movable between the closed position of FIG. 6A and the open position as represent in FIG. 6B respectively at the beginning of the forming cycle and at the end of the forming cycle.

Other structural and operative features of the bending assembly 10 of the present invention include a brace assembly comprising at least one but more preferably a plurality of brace members as at 52 and 54. The brace members 52 and 54 are respectively dimensioned and configured to fit within the interior of the different portions of the channel stock 12 or other stock material so as to eliminate or significantly reduce the possibility of unwanted deforming of the stock material 12 as represented in FIG. 9. More specifically, the brace member 54 comprises an elongated configuration formed of plastic or other appropriate material. Also, the brace member 54 is dimensioned and configured to fit within the elongated slots or grooves 58 defining the opposite, spaced apart, peripheral edges of the open channel 59 of the channel stock 12. The elongated brace member 54 is formed of a material having sufficient structural integrity or rigidity to maintain a desired and/or original transverse dimension of the open channel 59 by at least partially absorbing or accommodating the forces applied to the channel stock 12 during the forming cycle. The structural characteristics of the material from which the elongated brace 54 is formed should also be such as to maintain the secured positioning of the brace member 54 within the spaced apart grooves 58 during the entire forming cycle as the stock material 12 is bent into a predetermined curved configuration as represented in FIG. 8. Accordingly the length of the brace member should be sufficient to extend along the length of the portion of the channel stock 12 being bent. As should be apparent, the predetermined curved configuration is equivalent to the predetermined curved configuration of the forming channel 30 as it extends about the periphery of the forming die/movable section 18.

Figure 7B:
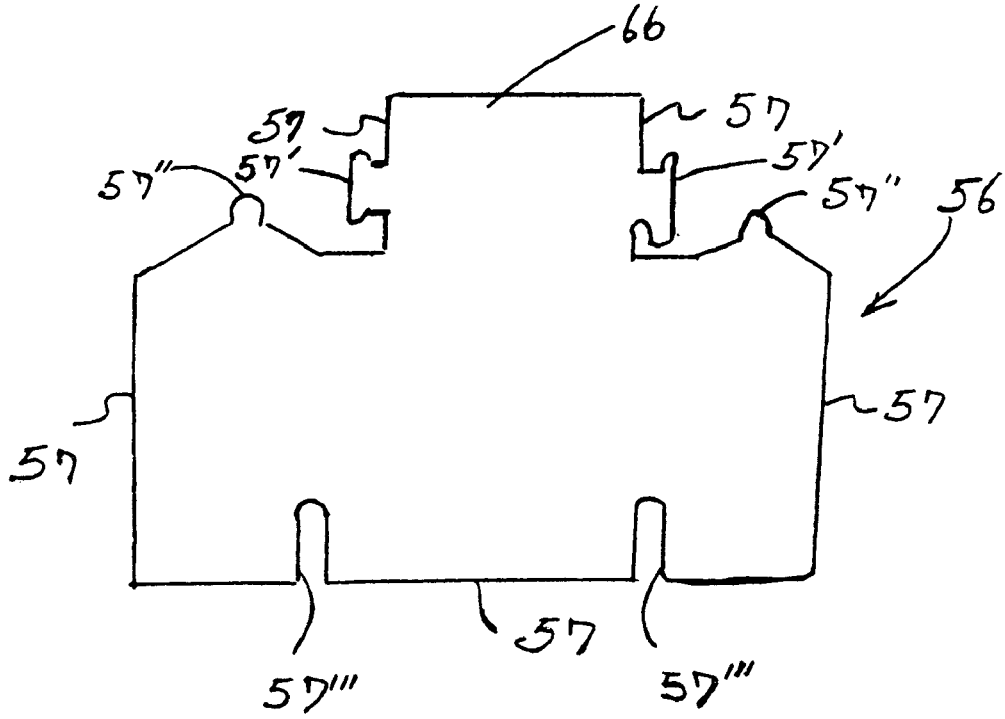
FIG. 7B is an end view of a brace block comprising a portion of a brace assembly represented as having a transverse sectional configuration corresponding to the interior, transverse sectional configuration of the channel stock material being bent and represented in FIG. 7A.

As set forth above, the brace assembly also comprises an additional brace member or brace block 56 structured to substantially correspond to the transverse or sectional interior dimension and configuration of the stock material 12 at least at the one end 12". As such the brace block is removably but securely disposed into the corresponding end portion 12" of the channel stock. As represented in FIGS. 7A and 7B the outer peripheral surface configuration of the brace block or member 56 corresponds to the sectional configuration if the interior surface of the end 12". As such, the outer peripheral surface segments 57 are disposed in substantially confronting engagement with the corresponding interior surface segments of the end 12" of the channel stock 12. For example surface segments 57' and 57" are dimensioned to fit within corresponding channels or recesses 58 and 58' respectively. Similarly, slots 57'" are disposed to surround and/or substantially enclose, and therefore confront, the exterior surfaces of projections 58". Therefore, the presence of the brace assembly specifically including the elongated brace member 54 and the other block-like brace member 56, being disposed within corresponding portions of the channel stock or stock material 12 will serve to prevent or restrict the possibility of unwanted deformation of the stock material 12 during the forming cycle by at least partially resisting or absorbing the forces exerted on the channel stock 12.

Another structural feature of the brace member 56 is the dimensioning of the outer top or end portion 66 such that it protrudes outwardly through the open channel 59 between and beyond the grooves 58 as well as the contiguous material portions serving to at least partially define the grooves 58 and the other portions of the periphery of the open channel 59. The disposition of the end portion 66 through and outwardly from the open channel 59 restricts the possibility of unwanted deformation and or displacement, such as by twisting of the corresponding parts of the end 12" and or stock material piece 12, during the forming cycle. Further, when operatively positioned within the interior of the stock material 12, the brace members 54 and 56 are disposed in adjacent and/or abutting relation to one another as represented in FIG. 2.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A bending assembly for channel stock material comprising:

a mandrel disposed in supporting engagement with the channel stock material;

a forming die including a movable section being movably mounted relative to said mandrel at a location fixedly positioned relative to said mandrel and relative to a path of travel of said movable section during a formation cycle;

said movable section including a forming channel having a predetermined curved configuration disposed and dimensioned to continuously receive the channel stock material therein during travel of said movable section through said forming cycle;

a locking assembly structured to lockingly secure the channel stock material to said movable section for movement therewith;

a bracing assembly having a plurality of brace members each disposed within predetermined interior portions of the channel stock material during said forming cycle, wherein at least two of said plurality are disposed in confronting arrangement with corresponding interior surface portions of the channel stock material to restrict deformation of the stock material during said forming cycle; at least one of said plurality having an elongated configuration disposed within at least a majority of a length of the stock material; and at least another of said plurality disposed on an interior end portion of the channel stock material and having a substantially block-like configuration corresponding in dimension and shape to the sectional interior of one end of the channel stock material;

said movable and fixed sections cooperatively disposed and structured to force a length of the stock material into and along a length of said forming channel and into said predetermined curved configuration substantially corresponding to said forming channel during travel of said movable section through said forming cycle.

2. A method for bending channel stock material comprising:

providing a mandrel disposed in supporting engagement with the channel stock material;

providing a forming die including a movable section being movably mounted relative to said mandrel at a location fixedly positioned relative to said mandrel and relative to a path of travel of said movable section during a formation cycle; said movable section including a forming channel having a predetermined curved configuration disposed and dimensioned to continuously receive the channel stock material therein during travel of said movable section through said forming cycle;

providing a locking assembly structured to lockingly secure the channel stock material to said movable section for movement therewith;

providing a bracing assembly having a plurality of brace members each disposed within predetermined interior portions of the channel stock material during said forming cycle, wherein at least two of said plurality are disposed in confronting arrangement with corresponding interior surface portions of the channel stock material to restrict deformation of the stock material during said forming cycle; at least one of said plurality having an elongated configuration disposed within at least a majority of a length of the stock material; and at least another of said plurality disposed on an interior end portion of the channel stock material and having a substantially block-like configuration corresponding in dimension and shape to the sectional interior of one end of the channel stock material;

adapting said assembly to force a length of the stock material into and along a length of said forming channel and into said predetermined curved configuration substantially corresponding to said forming channel during travel of said movable section through said forming cycle.

3. A device for bending lengths of stock channel material having a particular cross section comprising;

a fixed mandrel adapted to hold a length of said stock channel material;

a partially circular rotatable die having an exterior edge, the exterior edge containing a forming channel of generally curved cross-section;

a fixed forming piece adapted to cooperate with said partially circular die during a forming cycle to bend said length of stock channel material;

a locking assembly adapted to hold the stock channel material against said forming channel;

a plurality of thin cross sectional removable brace members adapted to be inserted into said stock channel material, said cross sectional brace members having shape matching said particular cross-section;

at least one elongated longitudinal brace member adapted to be inserted lengthwise into said stock channel material;

said partially circular rotatable die and said fixed forming piece cooperative disposed and structured to continuously receive said stock channel material into said forming channel during travel of said partially circular rotatable die through said forming cycle.

4. The device of claim 3 wherein said forming cycle is defined by one end portion of the stock channel material removably locked within said forming channel and continuous forced placement of at least a portion of the length of the stock channel material into the forming channel during rotation and travel of the partially circular rotatable die.

* * * * *